United States Patent [19]

Bohnenkamp

[11] Patent Number: 4,548,064

[45] Date of Patent: Oct. 22, 1985

[54] STRIP-ROLLING STAND WITH BUILT-IN ROLL-CUTTERS

[75] Inventor: Heinrich Bohnenkamp, Neuss, Fed. Rep. of Germany

[73] Assignee: SMS Schloemann-Siemag AG, Dusseldorf, Fed. Rep. of Germany

[21] Appl. No.: 524,833

[22] Filed: Aug. 19, 1983

[30] Foreign Application Priority Data

Aug. 23, 1982 [DE] Fed. Rep. of Germany ..... 8223755

[51] Int. Cl.[4] ..... B21B 28/04

[52] U.S. Cl. ..... 72/236; 29/33.5; 72/241; 241/101.2; 241/227

[58] Field of Search ..... 72/236, 240–248; 241/227, 235, 101.2; 29/148.4 D, D33.5, 56.5; 51/262 A

[56] References Cited

U.S. PATENT DOCUMENTS 3,603,125 9/1971 Edwards ..... 72/236 X

FOREIGN PATENT DOCUMENTS 955131 7/1949 Fed. Rep. of Germany .
1037804 8/1958 Fed. Rep. of Germany .
2206912 8/1972 Fed. Rep. of Germany .
887787 8/1983 Fed. Rep. of Germany .
33106 4/1981 Japan ..... 72/236
137011 8/1982 Japan ..... 72/236
1395973 5/1975 United Kingdom .

*Primary Examiner*—Mark Rosenbaum
*Attorney, Agent, or Firm*—Karl F. Ross; Herbert Dubno

[57] ABSTRACT

A rolling stand including a pair of working rolls and associated backing rolls, the working rolls defining a nip through which a strip can be advanced in a succession of passes forming a single run, so that with each pass the thickness and widths of the strip are reduced. The working rolls have end regions projecting laterally beyond the longitudinal edges of the strip, and machining devices are provided on the frame of the stand to reduce the diameters of the projecting end regions of the working rolls after each pass during a single run so that the working rolls ony contact the respective backing rolls along a distance equal generally to the strip width. Each machining devices includes a support carrying a material-removing tool engageable with the juxtaposed end region of a respective run of the working rolls, each support being pivotable about the respective backing-roll axis and linearly displaceable along the respective working-roll end region to enable the respective tool to be moved both perpendicularly and parallel to the axis of the working roll. Respective stop elements pivotable about pivot axes parallel to the working-roll axes carry eccentric stops which are engageable with the tool supports to define the radially innermost end positions of the supports.

6 Claims, 2 Drawing Figures

STRIP-ROLLING STAND WITH BUILT-IN ROLL-CUTTERS

FIELD OF THE INVENTION

The present invention relates to a strip-rolling apparatus. More particularly this invention concerns such an apparatus where the effective length of the working rolls is reduced as the strip becomes narrower.

BACKGROUND OF THE INVENTION

Thick and wide strip material, e.g. steel strip, is reduced in size, and its strength and flexibility are increased by moving it in a run consisting of a multiplicity of passes between rolls that compress it with great force. Such action, combined with some tension in the strip, decreases the workpiece thickness and its width, while increasing the length of the strip. (As here intended, the thickness of the workpiece is its smallest dimension as compared to its length which extends in the travel direction and its width which is perpendicular thereto and to the compression direction.) The workpiece travel speed increases slightly with each pass between the rolls.

The rolling is done in roll stands each comprising two parallel and small-diameter working rolls that define a nip through which the strip passes. A pair of large-diameter backing rolls flank these working rolls, each backing roll engaging the respective working roll in line contact and urging it toward the other working roll. Thus the working rolls can exert enormous pressure on the workpiece because of the small contact area.

The natural tendency of this force to bend these small-diameter working rolls outward away from the workpiece is countered by the stiffer large-diameter backing rolls. In addition complex systems are provided to oppositely bend the backing and working rolls so they are convex toward the workpiece to substantially eliminate any bend in the working rolls.

The workpiece width is invariably smaller than the effective width of the rolls, which are cylindrical with stub shafts on their ends so this effective width is the length of the middle large-diameter cylindrical portion. The contact width, that is the length of the contact zone between the workpiece and the working rolls measured parallel to the roll rotation axes which are in a plane perpendicular to the workpiece travel direction, is generally equal to slightly less than the effective roll width for the first pass, which may include several passages through a given roll stand, and is a small fraction of this effective width for the last pass. The disparity between effective roll length and workpiece width therefore increases during the run.

In addition to bending, the working rolls are subject to limited elastic deformation in the form of a flattening in the region of contact with the workpiece. The out-of-contact end portions of the two working rolls are not flattened, but are cylindrical, so the nip between the working rolls is slightly smaller to both sides of the workpiece than at the workpiece. As a result the longitudinal strip edges are subjected to greater pressure and are compressed, a phenomenon known as edge drop. Thus the strip workpiece is not of uniform thickness.

To overcome this problem the above-mentioned roll-bending equipment is used to bring pressure on the working-roll ends. Obtaining enough bend to cancel out the above-described flattening of the rolls is very difficult.

In addition it is known to make the working rolls slightly barrel-shaped so that, when they bend, their side in contact with the workpiece is perfectly straight. The problem with this type of arrangement is that the rolls then are only suitable for use for a limited range of workpiece widths, needing complex remachining for different sizes.

In another known system, such as described in German Pat. No. 955,131 and German ALS No. 2,206,912, the working rolls are braced against outwardly tapered or barrel-shaped intermediate backing rolls in turn backed up by cylindrical rolls. The frustoconically tapered end regions of the intermediate backing rolls start above level with the strip edges. Thus as band width changes the intermediate backing rolls must be changed also, necessitating the use of complex supports for the rolls as well as a magazine of different roll sizes.

A solution to this problem has been the use of intermediate backing rolls which each have only one tapered end region and which can be moved axially in the roll stand. The edge of this end region is aligned vertically with a respective workpiece edge, and is moved in as the rolling operation progresses and the workpiece becomes narrower. Obviously the equipment that does this is extremely complex, expensive, and difficult to operate. In addition such uneven bending of the working rolls creates a workpiece of nonuniform thickness in its central regions. The working rolls in such a system also wear at an excessively fast rate.

In copending and commonly owned patent application Ser. No. 469,137 filed Feb. 23, 1983 by H. Feldman et al, now U.S. Pat. No. 4,479,374 issued Oct. 30, 1984, a rolling method is described in which the diameters of the projecting ends of the working rolls are reduced by removal of material from them several times after respective passes in a single run so that the working rolls only contact the respective backing rolls along a distance equal generally to the workpiece width.

This decrease in effective roll width as the workpiece width decreases during a run takes the end portions of the working rolls out of contact with the backing rolls. The center portions of the working rolls are meanwhile flattened somewhat both on the side in contact with the workpiece and diametrally opposite thereto on the side in contact with the respective backing rolls. The end region of each working roll is not in contact with the workpiece, however, so it is not flattened on this side. Similarly since these end regions are of smaller diameter than the rest of the central part of the rolls they do not touch the backing rolls either and are not flattened on this side.

If these end regions were not cut away they would contact the backing rolls which would therefore bow the working rolls somewhat toward each other, causing excessive compression of the workpiece at the edge, so-called edge drop. Periodically reducing the effective width of the working rolls symmetrically to a central plane longitudinally bisecting the workpiece and perpendicular to the working-roll axes eliminates this effect. In use the working rolls might still bend slightly and contact the backing rolls at their cut-in end regions, but even so the finished workpiece will exhibit virtually no edge drop.

This procedure is still relatively laborious, as it normally is necessary to take the rolls off the stand to machine each time the diameter is to be reduced. Even if the material-removing machinery, such as a grinder, is mounted right on the roll stand, its operation is usually difficult, in particular with respect to dimensional accuracy.

OBJECTS OF THE INVENTION

It is therefore an object of the present invention to provide an improved strip-rolling stand or apparatus.

Another object is the provision of such a strip-rolling apparatus which overcomes the above-given disadvantages, that is which makes it easy to reduce the diameters of the ends of the working rolls.

SUMMARY OF THE INVENTION

A rolling stand according to the invention has a frame bearing a pair of working rolls centered on and rotatable about respective parallel axes and defining a nip. Thus a strip can pass in each of a succession of passes forming a single run through the nip so that with each pass the thickness and width of the strip are reduced. The working rolls each have ends laterally beyond the longitudinal edges of the strip. Respective backing rolls mounted on the frame centered on and rotatable about respective parallel axes extend generally the full length of the working rolls and are braced toward the nip against the working rolls to urge same against the strip. Machining means mounted on the frame reduces the diameters of the projecting ends of the working rolls after each pass during a single run so that the working rolls only contact the respective backing rolls along a distance equal generally to the workpiece width. The machining means includes respective supports each carrying a material-removing tool engageable with the respective ends of the working rolls, each pivotal about the respective backing-roll axis so as to move the respective tool at least generally radially of the respective working roll, and each displaceable axially along the respective working-roll end. Respective pivots define axes fixed relative to the frame and extending parallel to the respective working roll axes. Respective stop elements extend along and pivotal about the respective pivot axes. Respective eccentric stops are carried on the stop elements and enggeable away from the respective working roll against the supports. Thus the radially innermost end position of the respective support is defined by each eccentric stop.

Such an apparatus can rapidly cut down a roll between passes, and can even function during a pass, using the natural revolution of the working rolls to lathe or grind them down.

According to the present invention the tool is a grinding wheel and the machining means includes means for rotating the wheel. The tool could also be a simple lathe bit or a milling head, or constructed as described in the above-cited copending application.

The pivot axes are each movable relative to one of the respective roll axes. Normally they are set so that at the angular setting of the eccentrics corresponding to the radial outermost spacing of the respective tool from the respective working-roll axis the tool barely touches the cylindrical working-roll surface. Then the eccentrics are turned an angle, and as a strip makes its run, passing back and forth between the working rolls, spindles extending axially through the supports are rotated to edge them inward, thereby reducing the effective-roll width as the workpiece width decreases. At the end of the run one of the cutters of each roll is run completely across the working roll, and then both of the tools are moved to their outermost positions. The stops are then pivoted slightly, and the next run can start, with a tiny amount of between 0.1 mm and 1.8 mm. preferably between 0.2 mm and 1 mm, being machined off the roll surface with each run. Not only does such operation eliminate edge drop from the workpiece, but it continuously refreshes the working roll surfaces to produce an extremely smooth product.

In accordance with another feature of this invention each of the stop elements is provided with a radially extending arm angularly fixed relative to the respective eccentric stop. The machining means further comprises respective drive means connected to the ends of the arms remote from the respective stop elements.

Preferably the stop elements according to the invention are rods and each of the eccentric stops has a rounded offcenter outer surface. Each of the supports carries a plate engageable with the respective stop and perpendicularly facing the respective pivot axis, that is lying on a plane perpendicular to a plane including the axis. Thus extremely exact positioning of the tools is ensured.

DESCRIPTION OF THE DRAWING

The above and other features and advantages will become more readily apparent from the following, reference being made to the accompanying drawing in which.

SPECIFIC DESCRIPTION

Figure 1:
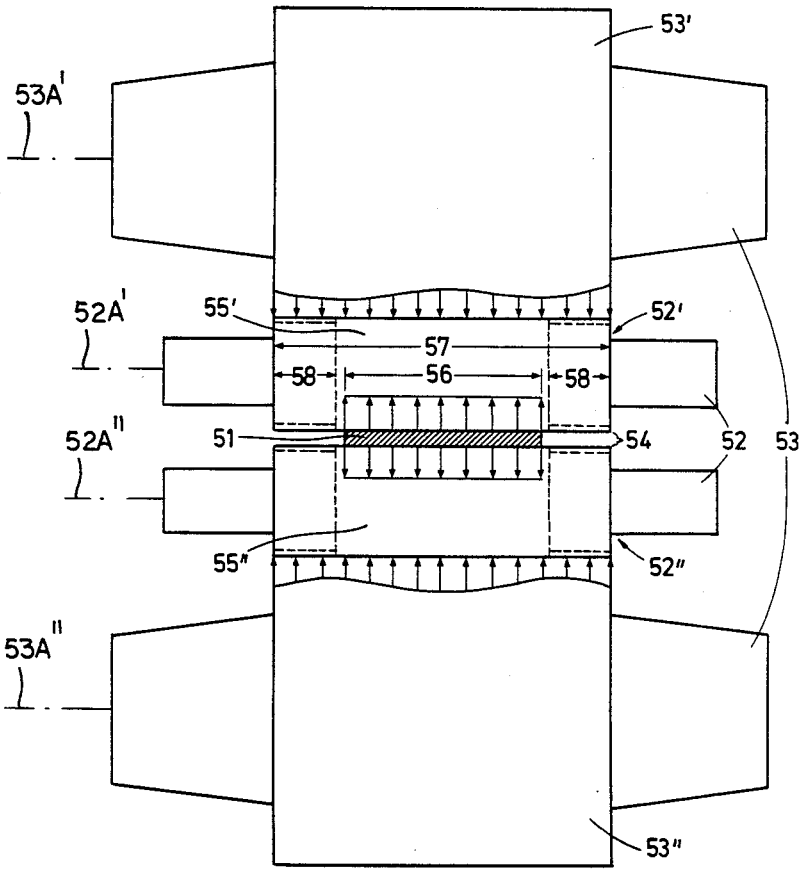
FIG. 1 is an end view of a roll stand according to this invention.

The instant invention is aimed at a method and apparatus for rolling out a strip workpiece 51 whose starting width is reduced with successive passes to ever-smaller widths. This width reduction is accompanied by a thickness reduction, that is a reduction in an up-and-down direction as seen in the drawing.

Such width reduction is effected by a pair 52 of rolls 52' and 52" rotatable about parallel horizontal axes 52A' and 52A" and defining a horizontally throughgoing slot or nip 54. The rolls 52' and 52" have central portions 55' and 55" which to start with, that is when the workpiece 51 with its original maximum width is being rolled, have an effective length 57 which is slightly greater than the workpiece width 56.

After the first pass or passes according to the invention, that is once the workpiece width is reduced from width 56 to a smaller width, the central portions 55' and 55" are machined down to have an effective width equal to less than the effective width 57 but slightly more than the current workpiece width. This leaves projecting end portions 58 that are out of engagement with the workpiece 51 altogether. It is these projecting end portions 58 that have been machined down according to this invention, that is the roll diameter has been reduced at them.

Subsequently as the workpiece width decreases, the effective roll width is correspondingly reduced by machining of ever widening projecting end regions. In fact all that is machined down between passes is a bit more of each end region, enough to increase the end-region length to the desired extent so the remaining central portion has a length equal generally to the workpiece width.

The roll pair 52 is backed up by a pair 53 of large-diameter backing rolls 53' and 53" rotatable about respective parallel axes 53A' and 53A" parallel to and coplanar with the axes 52A' and 52A". Further backing rolls could be used without departing from the instant invention, so long as the one or more backing rolls in direct contact with each working roll have an axial length equal at least to the width 56, that is so that at the start of each run the rolls engage each other along a line whose length is at least equal to the width 56.

Thus the decrease in effective roll width as the workpiece width decreases during a run takes the end portions 58 out of contact with the backing rolls 53' and 53". The center portions 55' and 55" are meanwhile flattened somewhat both on the side in contact with the workpiece 51 and diametrally opposite thereto on the side in contact with the respective backing rolls 53' and 53". The end region of each roll portion 55' and 55" is not in contact with the workpiece 51, however, so it is not flattened on this side. Similarly since these end regions are of smaller diameter than the rest of the central part of the rolls they do not touch the backing rolls either and are not flattened on this side. If these end regions were not cut away they would contact the backing rolls which would therefore bow the working rolls somewhat toward each other, causing excessive flattening of the workpiece at the edge, so-called edge drop. Periodically reducing the effective width of the working rolls symmetrically to a central plane longitudinally bisecting the workpiece and perpendicular to the working-roll axes according to this invention eliminates this effect.

Of course the backing rolls could be cut down instead for the same effect and advantage, but since these backing rolls only need occasional machining, whereas the working rolls need frequent machining, it is more practical to machine the working rolls. In fact with the system of this invention, with at most a modest machining of the working rolls after each pass of the workpiece through them, it is possible to reduce the machining needed at the end of the operation considerably. This final machining after the run to return to maximum working-roll width can also be carried out according to this invention without taking the working rolls out of the roll frame.

According to this invention the working roll diameter is reduced by between 0.2 mm and 1.0 mm, at the end regions. The effective width of the rolls can be reduced to less than that of the workpiece 51. It is also possible to reduce the effective working-roll width so it is greater than the workpiece width. Both procedures lie within the scope of this invention, so long as the end-region width is increased regularly within a single run as the workpiece width decreases. It is also possible for the cut-in end regions to be of frustoconical shape, rather than cylindrical as shown in FIG. 1. The cone angle relative to the working-roll axis decreases as the width of the cut-in end regions increases.

Figure 2:
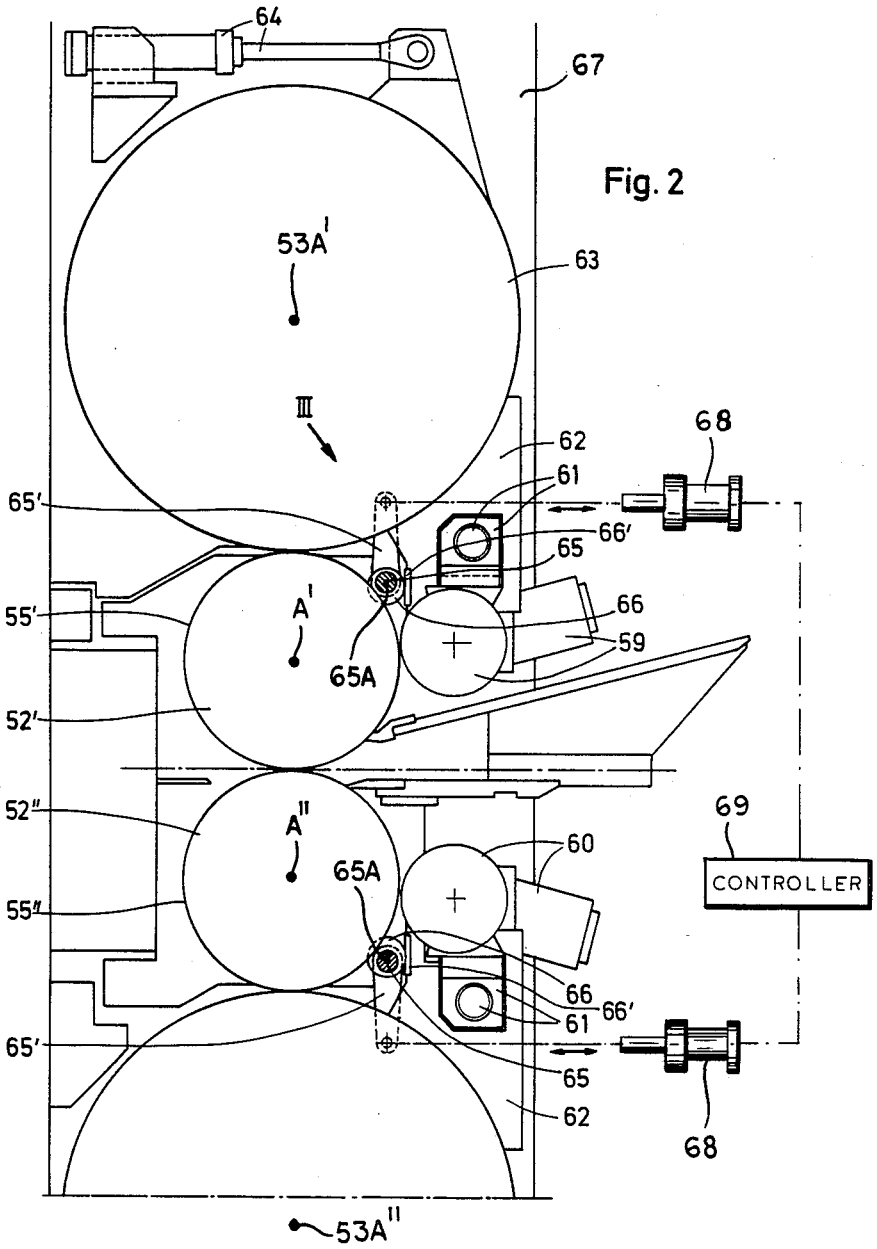
FIG. 2 is a large-scale side view of the roll stand of this invention.

FIG. 2 shows how the rolls 52' and 52" are carried in a frame 67. Grinders 59 and 60 (two for each working roll) are carried on traverses 62 and are each movable therealong relative to the frame 67 by a screw-type drive arrangement 61. The traverses 62 in turn are carried on support rings 63 coaxial with the backing rolls 53' and 53" and journaled for rotation about the axis 53A' or 53A" of the respective backing rolls 53' and 53". They are each movable by a double-acting hydraulic ram 64 to force the grinders 59 and 60 against the rolls 52' and 52". A sprayer and flexible scraper prevent the shavings, chips, or the like from getting onto the workpiece where they would create intolerable inclusions.

Also journaled in the frame 67 at axes 65A are respective stop elements or adjustment rods 65 extending parallel to the axes 52A' and 52A" and to the respective spindle-drive arrangements 61. These rods 65 are each provided with a radially extending arm 65' operable by another double-acting hydraulic ram or actuator 68 operated in turn by a controller 69.

Each of these rods 65 carries one or more eccentrics 66 that are engageable generally radially of the respective axes 52A' and 52A" with abutment plates 66' carried on the traverses 62, which are as mentioned above pivotal about the respective working roll axes 53A' and 53A". The angular position of each rod 65 therefore determines the radially inner end position for the respective grinder 59 or 60. Due to the length of the lever arms 65' compared to the eccentricity of the eccentric stops 66, a factor of at least 10, it is possible to achieve extremely fine control of the end positions. The spindle-type grinder moving arrangement 61 can similarly be controlled with great accuracy, so the roll pair 52 will be turned down the perfect amount each time.

As described in the above-cited copending patent application, in a standard such system the working rolls 52' and 52" engage the backing rolls 53' and 53" along a width of 2.240 m. The effective roll width is set at the workpiece width plus $2\times50$ mm. Using workpieces varying between 700 mm and 2080 mm wide, superior results, that is more uniform workpiece thickness, were obtained, especially at the longitudinal edges, than has been possible hitherto with the known systems. In fact with the known systems as the difference between the effective roll width and the contact width increases the variation in workpiece thickness similarly increases. In addition the instant invention works well in combination with prior-art systems wherein the working rolls are bent, and when combined with such systems produces extremely good results. The bending force can be reduced to about one-seventh that normally used to obtain the same shape, so long as the contact width, which is equal to the workpiece width, does not vary by more than 50 mm to 100 mm from the effective roll width, that is the axial dimension between its cut-in end portions.

With the system of this invention the spindles of the units 61 are rotated either continuously or discontinuously to move the respective tool units or grinders 59 and 60 axially along the respective working rolls 52' and 52" during a single run of a single strip workpiece. This reduces the diameter as described above.

At the end of the run, the controller 69 simultaneously retracts one of each of the pairs of grinders 59 and 60 away from the other grinder 59 or 60 of the same pair to its axially outermost position, and moves the other grinder 59 or 60 all the way toward the retracted grinder, leaving the surface of the respective working roll 52' or 52" perfectly cylindrical. In fact this grinder is then moved back to its outermost position to perfectly finish the respective drum's surface. Thereafter the arms 65' are moved through a slight angular increment by the controller 69 to move the supports or traverses 62 radially in another 0.2 mm to 1 mm, and the spindles then move the paired grinders 59 and 60 toward each other again to start another cycle.

I claim:

1. In a rolling stand including a frame;

a pair of working rolls mounted on said frame centered on and rotatable about respective parallel axes and defining a nip through which a strip can pass in each of a succession of passes forming a single run so that with each pass the thickness and width of the strip are reduced, said working rolls each having opposite end regions projecting laterally beyond the longitudinal edges of the strip passing through the nip;

respective backing rolls mounted on said frame centered on and rotatable about respective parallel axes, said backing rolls extending generally the full length of said working rolls and being braced toward the nip against said working rolls to urge the latter toward one another and against the strip; and machining means mounted on said frame for reducing the diameters of said projecting end regions of said working rolls after each pass during a single run so that said working rolls only contact the respective backing rolls along a distance equal generally to the width of the strip;

the improvement comprising that said machining means comprises:

(a) a plurality of supports each juxtaposed to a respective end region of an associated working roll and carrying a material-removing tool engageable with that end region of said associated working roll, means mounting each of said supports for pivotal movement about the axis of the backing roll bearing against said associated working roll, thereby to enable the material-removing tool carried by each of said supports to be moved at least generally radially of the respective working roll, and means mounting each of said supports for translational displacement parallel to the axis of said associated working roll along the respective working-roll end region, (b) respective pivots defining pivot axes fixed relative to said frame and parallel to the respective working-roll axes, (c) respective stop elements each extending along an associated one of said working rolls and being mounted for pivotal movement about the respective fixed pivot axis, and (d) respective eccentric stops carried by and movable with said stop elements, each of said eccentric stops being directed generally away from the respective working roll and toward an associated one of said supports for engagement with the latter, each of said eccentric stops defining, for any given pivoted position of the associated stop element, the radially innermost end position of the respective material-removing tool relative to the juxtaposed end region of the associated working roll.

2. The roll stand defined in claim 1 wherein each material-removing tool is a grinding wheel and said machining means includes means for rotating said wheel.

3. The roll stand defined in claim 1 wherein said pivots defining said fixed pivot axes are movable relative to the respective roll axes.

4. The roll stand defined in claim 1 wherein each of said stop elements is provided with a radially extending arm angularly fixed relative to the respective eccentric stop, and said machining means further comprise respective drive means connected to the ends of said arms remote from the respective stop elements.

5. The roll stand defined in claim 4 wherein said stop elements are rods.

6. The roll stand defined in claim 1 wherein each of said eccentric stops has a rounded offcenter outer surface, and each of said supports carries a plate engageable with the respective stop and facing the respective pivot axis and parallel thereto.

* * * * *